US005919549A

United States Patent [19]

Van et al.

[11] Patent Number: 5,919,549

[45] Date of Patent: Jul. 6, 1999

[54] ABRASIVE ARTICLES AND METHOD FOR THE MANUFACTURE OF SAME

[75] Inventors: Loc X. Van, Woodbury; Eugene J. Miller, Maplewood; Leonard E. Nelson, Oakdale, all of Minn.

[73] Assignee: Minnesota Mining and Manufacturing Company, St. Paul, Minn.

[21] Appl. No.: 08/753,664

[22] Filed: Nov. 27, 1996

[51] Int. Cl.[6] ..... C09K 3/14; B32B 5/16

[52] U.S. Cl. ..... 428/141; 428/147; 428/148; 428/149; 428/175; 428/240; 428/241; 428/242; 428/245; 428/302; 51/298; 51/307; 51/309

[58] Field of Search ..... 428/141, 147, 428/148, 149, 175, 240, 241, 242, 245, 302; 51/298, 307, 309

[56] References Cited

U.S. PATENT DOCUMENTS

| | | | |
|---|---|---|---|
| 2,958,593 | 11/1960 | Hoover et al. | 51/295 |
| 3,688,453 | 9/1972 | Legacy et al. | 51/400 |
| 3,976,525 | 8/1976 | Mednick | 156/72 |
| 4,227,350 | 10/1980 | Fitzer | 51/295 |
| 4,298,356 | 11/1981 | Teschner et al. | 51/297 |
| 4,314,827 | 2/1982 | Leitheiser et al. | 51/298 |
| 4,331,453 | 5/1982 | Dau et al. | 51/298 |
| 4,623,364 | 11/1986 | Cottringer et al. | 51/309 |
| 4,652,274 | 3/1987 | Bloettcher et al. | 51/298 |
| 4,652,275 | 3/1987 | Bloecher et al. | 51/298 |
| 4,744,802 | 5/1988 | Schwabel | 51/309 |
| 4,770,671 | 9/1988 | Monroe et al. | 51/293 |
| 4,799,939 | 1/1989 | Bloecher et al. | 51/293 |
| 4,881,951 | 11/1989 | Wood et al. | 51/309 |
| 4,903,440 | 2/1990 | Larson et al. | 51/298 |
| 5,061,294 | 10/1991 | Harmer et al. | 51/295 |
| 5,137,542 | 8/1992 | Buchanan et al. | 51/295 |
| 5,178,646 | 1/1993 | Barber, Jr. et al. | 51/298 |
| 5,203,884 | 4/1993 | Buchanan et al. | 51/295 |
| 5,236,472 | 8/1993 | Kirk et al. | 51/298 |
| 5,306,319 | 4/1994 | Krishnan et al. | 51/298 |
| 5,346,516 | 9/1994 | Alkhas et al. | 51/296 |
| 5,378,252 | 1/1995 | Follensbee | 51/298 |
| 5,482,756 | 1/1996 | Berger et al. | 428/36.2 |
| 5,667,842 | 9/1997 | Larson et al. | 427/258 |
| 5,685,935 | 11/1997 | Heyer et al. | 156/178 |

FOREIGN PATENT DOCUMENTS

| | | |
|---|---|---|
| 0 045 408 A1 | 2/1982 | European Pat. Off. . |
| 0 447 885 A2 | 9/1991 | European Pat. Off. . |
| 0716 903 A1 | 12/1995 | European Pat. Off. . |
| 57-008082 | 1/1982 | Japan . |
| 60-177871 | 9/1985 | Japan . |
| 61-025776 | 2/1986 | Japan . |
| 1 095 007 | 12/1967 | United Kingdom . |
| 2 247 201 | 2/1992 | United Kingdom . |

OTHER PUBLICATIONS

Lumina Zirconia NZ Alumdum Technical Bulletin, Norton Company, dated Nov. 1989.

White Fused Aluminum Oxide 38 Alundum Technical Bulletin, Norton Company dated Nov. 1989.

Scotch–Brite Surface Conditioning Belts Product Brochure, Minnesota Mining and Manufacturing Company, stock No. 61–5000–8733–5, 1991.

U.S. application No. 08/474,289 entitled "Abrasive Articles Incorporating Addition Polymerizable Resins and Reactive Diluents, and Methods of Making Said Abrasive Articles". filed Jun. 7, 1995.

*Primary Examiner*—Randy Gulakowski

*Attorney, Agent, or Firm*—Daniel R. Pastirik; Scott A. Bardell

[57] ABSTRACT

Abrasive articles and a method for the manufacture of the articles are described. The articles comprise a backing having a first major surface and a second major surface; a first resin layer comprising a first hardened resin, the first resin layer extending over the first major surface of the backing; abrasive particles adhered within the first resin layer; a second resin layer applied over the first resin layer, the second resin layer comprising a second hardened resin; and a lofty, three dimensional, nonwoven web of fibers bonded to one another at their mutual contact points and extending through the first and second resin layers. The dry coating weights of the first and second hardened resins are about 400 g/m$^2$ or greater and preferably greater than about 600 g/m$^2$.

24 Claims, 1 Drawing Sheet

ABRASIVE ARTICLES AND METHOD FOR THE MANUFACTURE OF SAME

BACKGROUND OF THE INVENTION

Abrasive articles are used in the preparation of any of a variety of surfaces prior to painting or other surface treatments. In the preparation of such surfaces, various abrasive articles may be used to abrade the existing surface to thereby maximize the ability of the surface to bond with coatings such as paint and the like. Coated abrasive paper, cloth, or vulcanized fiber discs (typically mounted on a powered right-angle tool) are all suitable articles for the foregoing abrasive application. Available abrasive discs, while being sufficiently aggressive and capable of accomplishing the needed preparation of the surface, typically have relatively short useful lives and frequently leave visible grinding marks on the surface. Consequently, additional surface preparation is often needed to remove the grinding marks prior to the application of paint or other coating. This additional corrective surface preparation includes a finishing step using finer grades of coated abrasive discs or nonwoven abrasive surface conditioning articles to sufficiently decrease surface roughness. This two step grinding effort is both labor and time intensive, and it is desirable to at least reduce the need for the use of finer grade abrasives and, in certain abrasive applications, to eliminate the need altogether.

Nonwoven abrasive surface conditioning articles have been used in a wide variety of abrasive applications and are known to leave acceptable surface finishes, and nonwoven abrasive surface conditioning articles generally have long useful lives. In most surface conditioning applications, however, traditional nonwoven articles, when used alone, are not aggressive enough to adequately clean the surface to the extent needed.

Nonwoven and coated abrasive articles have been described in the patent literature.

U.S. Pat. No. 2,958,593 (Hoover et al.) describes low density open nonwoven fibers abrasive articles having a high void volume (e.g. low density). The nonwoven webs of the '593 patent are comprised of short fibers bonded together at their points of mutual contact to form a three dimensional integrated structure. Fibers may be bonded to one another with a resin/abrasive mixture, forming globules at the points of mutual contact while the interstices between the fibers remain substantially unfilled by resin or abrasive. The void volume of the disclosed structures typically exceed 90%.

U.S. Pat. No. 3,688,453 (Legacy et al.) describes abrasive articles such as belts suitable for off hand and automated article finishing. The belts comprise a lofty nonwoven web that is attached to a woven backing by needle tacking. The web is impregnated with resin and abrasive. According to Example 1, the webs are coated with a resin/abrasive slurry which is then dried to provide the finished article. The resin/abrasive is applied to achieve a dry coating weight 169 grains per 4 inch by 6 inch pad (708 g/m$^2$) and then is coated with a second abrasive/adhesive slurry at 78 grains per 4 inch by 6 inch pad (327 g/m$^2$).

U.S. Pat. No. 4,331,453 (Dau et al.) describes and abrasive articles comprising a lofty, nonwoven, three dimensional abrasive web adhesively bonded to stretch-resistant woven fabric with a polyurethane binder. The resin coating weights for the articles of the '453 patent, as stated in Example 1, are about 70 grains of an adhesive composition per 4 inch by 6 inch pad (293 g/m$^2$) followed by final abrasive-adhesive slurry at a dry coating weight of 225 grains per grains per 4 inch by 6 inch pad (942 g/m$^2$).

U.S. Pat. No. 5,178,646 (Barber, Jr. et al.) describes coatable thermally curable binder precursor solutions modified with a reactive diluent and an abrasive articles incorporating such binder precursor solutions. The coated abrasive articles of the '646 patent include a flexible backing such as a paper sheet or a cloth backing.

U.S. Pat. No. 5,306,319 (Krishnan et al.) describes surface treating articles utilizing an organic matrix such as nonwoven web that is substantially engulfed by a tough, adherent elastomeric resinous binder system. The articles of the '319 patent principally comprise surface treating wheels.

European Patent Application 0716903 A1 describes a coated abrasive product comprised of base resin coat, abrasive mineral grains and a size resin coat all applied on flexible backing material consisting of a nonwoven fiber mat. The nonwoven fiber mat is formed into a flat, wear and tear resistant backing by means of a binder or by the superficial dissolving or fusing of fibers. An abrasive layer comprising abrasive grain may be coated onto one or both sides of the nonwoven fiber mat.

In general, the art has failed to provide an abrasive article comprising an nonwoven substrate useful in the preparation of surfaces wherein the article is capable of being both sufficiently aggressive while providing a long useful life. Moreover, the art has failed to provide such an article which can also complete certain surface treating operations in a single step to provide an acceptable finish with reduced effort.

In light of the foregoing, it is desirable to minimize the amount of effort required in the preparation of certain surfaces prior the application of coatings such as paint, for example. It is desirable to provide an abrasive article useful in the preparation of surfaces wherein the article is capable being sufficiently aggressive and has a long useful life. Preferably, such an article can complete certain surface treatment operations in a single step to provide an acceptable finish in a minimized amount of time. It is also desirable to provide a method for the manufacture of the foregoing articles.

SUMMARY OF THE INVENTION

The present invention provides an abrasive article useful in the a variety of surface conditioning operations and a method for the manufacture of such articles.

In one aspect, the invention provides an abrasive article, comprising:

a backing having a first major surface and a second major surface;

a first resin layer comprising a first hardened resin, the first resin layer extending over the first major surface of the backing;

abrasive particles adhered within the first resin layer;

a second resin layer applied over the first resin layer, the second resin layer comprising a second hardened resin; and A lofty, three dimensional, nonwoven web of fibers bonded to one another at their mutual contact points and extending through the first and second resin layers.

The backing preferably is a woven reinforcing fabric and the web is attached to the backing by a needle tacking operation. The first and second resins are applied to the web to provide dry add-on weights of about 400 g/m$^2$ or greater, preferably 600 g/m$^2$ or greater and most preferably 800 g/m$^2$ or greater. Any of a variety of materials can be used as the first or second resins. However, a phenolic resin is preferred for use as the first resin (e.g., the make coat precursor) while phenolic and epoxy resins are suitable for use as a second resin (e.g., a size coat precursor). The nonwoven web is prebonded. That is, the web is typically treated to form a bond between the fibers at their points of mutual contact. A preferred treatment is to apply a prebond resin to the fibers. Preferred prebond resins include those which, upon hardening, are tough, rubbery or elastomeric binders. Preferred prebond resins include those comprising polyurethanes, polyureas, styrene-butadiene rubbers, nitrile rubbers and polyisoprene. Optionally, the article can include a super size coating applied over the foregoing second resin layer. Preferably, the super size coat is comprised of a hardened resin precursor selected from the foregoing preferred prebond materials.

As used herein, certain terms will be understood to have the meanings as set forth herein. "Fiber" or "filament" are used interchangeably herein to refer to a threadlike structure comprising any of the materials as described herein. In referring to the fibers of the nonwoven webs used to make the articles herein, "linear density" or "fineness" refers to the weight in grams for a given length of a single fiber. "Denier" is a unit of linear density indicating the weight in grams for 9000 meter length of fiber while "dtex" or "decitex" is another unit for linear density indicating the weight in grams for a 10,000 meter length of fiber. "Prebond resin precursor" refers to a coatable resinous material applied to the fibers of the nonwoven web to facilitate bonding of the fibers at their mutual contact points. "Prebond" refers to the hardened prebond resin precursor. "Make coat precursor" means a coatable resinous material applied to an article to secure abrasive grains thereto. The make coat precursor is also referred to as a first coatable composition. "Make coat" refers to the hardened (e.g., by radiation or thermal curing) make coat precursor. The make coat is also referred to as the first resin layer. "Radiation curable resin" means any material containing a resin or adhesive formulated to allow the resin or adhesive to be at least partially cured by exposure to radiation (e.g., ultraviolet radiation). "Size coat precursor" means a resinous material applied over the abrasive grains and make coat or make coat precursor. The size coat precursor is also referred to as the second coatable composition. "Size coat" refers to the hardened (e.g., by radiation or thermal curing) size coat precursor. The size coat is also referred to as the second resin layer. "Super size coat precursor" means a resinous material applied over the size coat or size coat precursor. "Super size coat" refers to the hardened (e.g., by radiation or thermal curing) super size coat precursor.

In another aspect, the invention provides an abrasive article, comprising:

a nonwoven web of fibers bonded to one another, the fibers defining a first major web surface, a second major web surface and a middle web portion extending between the first and second major web surfaces;

a first resin layer extending through the web and comprising a first hardened resin, the dry weight of the first resin layer being about 400 g/m$^2$ or greater;

abrasive particles adhered within the first resin layer;

a second resin layer applied over the first resin layer and comprising a second hardened resin, the dry weight of the second resin layer being about 400 g/m$^2$ or greater.

In this aspect of the invention, the article can further include the backing described above to provide abrasive discs or endless belts. Additionally, a plurality of the foregoing unbacked articles can be assembled into a compressed stack to provide a layered composite article which may be formed into a grinding wheel or the like.

In still another aspect, the invention provides a method for the manufacture of an abrasive article, comprising:

providing an open, lofty, three dimensional nonwoven web of fibers having a first major web surface and a second major web surface and a middle web portion extending therebetween, the fibers bonded to one another at their mutual contact points;

applying a first coatable composition to the nonwoven web in an amount sufficient to provide a dry coating weight of about 400 g/m$^2$ or greater;

applying abrasive particles to the first coatable composition;

at least partially hardening the first coatable composition;

applying a second coatable composition to the nonwoven web in an amount sufficient to provide a dry add-on weight of about 400 g/m$^2$ or greater; and hardening the second coatable composition.

In this aspect of the invention, the materials used as the first and second coatable compositions are as previously described. Additionally, the method may also comprise applying a third coatable composition or a size coat precursor to the nonwoven web to provide a dry add-on weight of about 200 g/m$^2$. If the resulting article is to be used in abrasive discs or endless belts, a reinforcing baking is applied to the second major surface of the web prior to the application of the first coatable composition. A needle tacking operation is preferably performed in order to affix the web to the backing prior to the application of adhesives.

Further details of the invention will be appreciated by those skilled in the art upon consideration of the remainder of the disclosure, including the detailed description of the preferred embodiment and the appended claims.

BRIEF DESCRIPTION OF THE DRAWINGS

In describing the preferred embodiment, reference is made to the various Figures, wherein.

DETAILED DESCRIPTION OF THE PREFERRED EMBODIMENT

Figure 1:
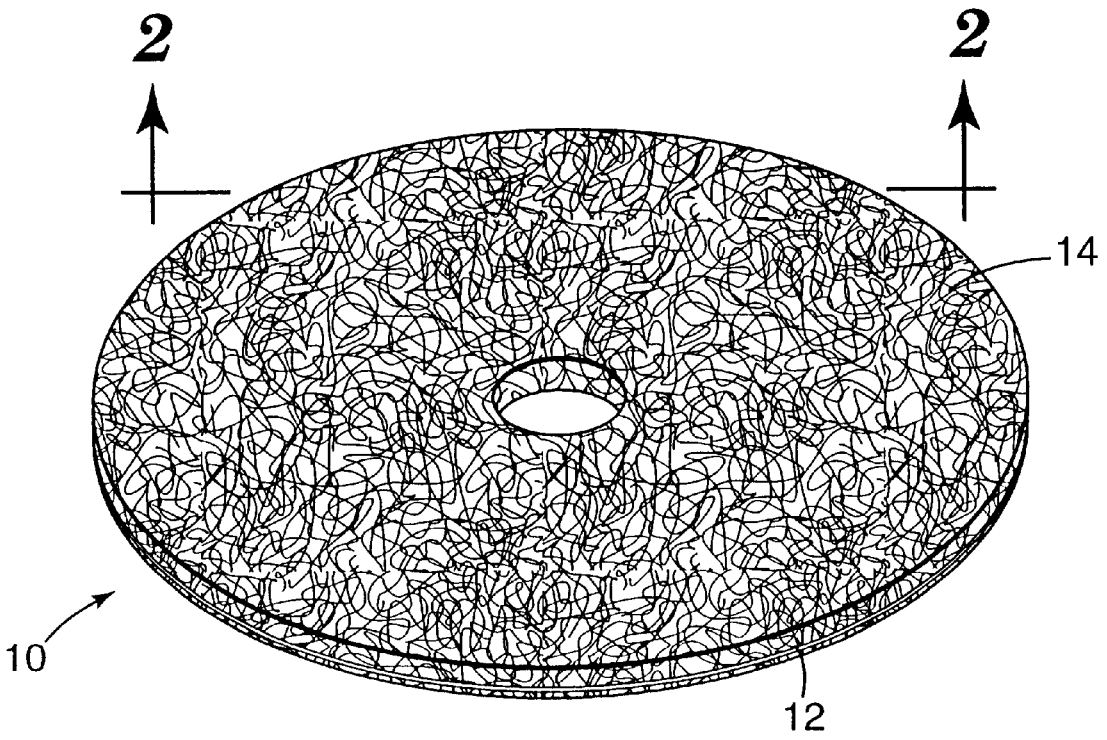
FIG. 1 is a perspective view of an abrasive disc of the invention.

The described embodiment is not to be construed as unduly limiting the scope of the present invention. In describing the preferred embodiment, structural details are depicted in the Figures and are referred to by use of reference numerals wherein like numbers indicate like structures.

Referring to the Figures, the invention provides a variety of surface conditioning articles such as the disc 10. Disc 10 includes a backing 12, a lofty, open, low-density, fibrous, non-woven web 14, a make coat or first resin layer 16 comprising a first hardened resin, abrasive particles 18 adhered within the first resin layer 16 and a size coat or second resin layer 20 applied over the first resin layer and comprising a second hardened resin. The abrasive articles of the invention can also be provided in the form of endless belts, surface conditioning wheels, hand pads or the like.

The backing 12 preferably is a dimensionally stable woven scrim cloth comprised of multi-filament tensilized organic fibers. The fibers should be able to withstand the temperatures at which coatable resinous materials are applied and cured without deterioration. Suitable fibers include nylon and polyester, and the backing 12 will preferably have a relatively open weave which may permit a degree of cooling when the article 10 is in use. The preferred tensile strength of the scrim 12 has less than 5% stretch, preferably less than 2.5%, at tensile loadings up to 100 lb/in. The backing is preferably a woven stretch-resistant fabric with a low-stretch value when pulled in opposing directions. Suitable materials for use as the reinforcing fabric in the articles of the invention include, without limitation, thermo-bonded fabrics, knitted fabrics, stitch-bonded fabrics and the like However, the invention is not to be limited to one reinforcing fabric over another.

A lofty, open, low-density, fibrous, non-woven web 14 is affixed to the backing 12. The nonwoven web preferably comprises first and second major web surfaces. The first major web surface is generally indicated by numeral 15 and forms the working surface of the article 10. The second major web surface 17 is positioned adjacent the backing 12. A middle web portion extends between the first and second major web surfaces. The web 14 is made of a suitable synthetic fiber capable of withstanding the temperatures at which impregnating resins and adhesive binders are cured without deterioration. Fibers suitable for use in the articles of the invention include natural and synthetic fibers, and mixtures thereof. Synthetic fibers are preferred including those made of polyester (e.g., polyethylene terephthalate), nylon (e.g., hexamethylene adipamide, polycaprolactum), polypropylene, acrylic (formed from a polymer of acrylonitrile), rayon, cellulose acetate, polyvinylidene chloride-vinyl chloride copolymers, vinyl chloride-acrylonitrile copolymers, and so forth. Suitable natural fibers include those of cotton, wool, jute, and hemp. The fiber used may be virgin fibers or waste fibers reclaimed from garment cuttings, carpet manufacturing, fiber manufacturing, or textile processing, for example. The fiber material can be a homogenous fiber or a composite fiber, such as bicomponent fiber (e.g., a co-spun sheath-core fiber). It is also within the scope of the invention to provide an article comprising different fibers in different portions of the web (e.g., the first web portion, the second web portion and the middle web portion). The fibers of the web are preferably tensilized and crimped but may also be continuous filaments such as those formed by an extrusion process described in U.S. Pat. No. 4,227,350 to Fitzer, incorporated herein by reference.

The nonwoven web 14 may be made by conventional air-laid, carded, stitch-bonded, spunbonded, wet laid, or melt blown procedures. One preferred nonwoven web is an air laid web, as described by Hoover et al. in U.S. Pat. No. 2,958,593, incorporated herein by reference. The non-woven web 14 may be formed on commercially available air lay equipment such as that available under the trade designation "Rando-Weber" commercially available from Rando Machine Company of Macedon, N.Y. Those skilled in the art will appreciate that the invention is not to be unduly limited to any particular method for the manufacture of the web 14.

Where the nonwoven web is of the type described by Hoover et al., identified above, satisfactory fibers for use in the nonwoven web are between about 20 and about 110 millimeters and preferably between about 40 and about 65 millimeters in length and have a fineness or linear density ranging from about 1.5 to about 500 denier and preferably from about 15 to about 110 denier. It is contemplated that fibers of mixed denier can be used in the manufacture of a nonwoven web in order to obtain a desired surface finish. Where a spunbond-type nonwoven material is employed, the filaments may be of substantially larger diameter, for example, up to 2 millimeters or more in diameter. Those skilled in the art will understand that the invention is not limited by the nature of the fibers employed or by their respective lengths, linear densities and the like.

Useful nonwoven webs typically have a weight per unit area at least about 50 g/m$^2$, preferably between 50 and 200 g/m$^2$, more preferably between 75 and 150 g/m$^2$. Lesser amounts of fiber within the nonwoven web will provide articles which may be suitable in some applications, but articles with lower fiber weights may have somewhat shorter commercial work lives. The foregoing fiber weights typically will provide a web, before needling or impregnation (described below), having a thickness from about 5 to about 200 millimeters, typically between 6 and 75 millimeters, and preferably between 10 and 30 millimeters.

Figure 2:
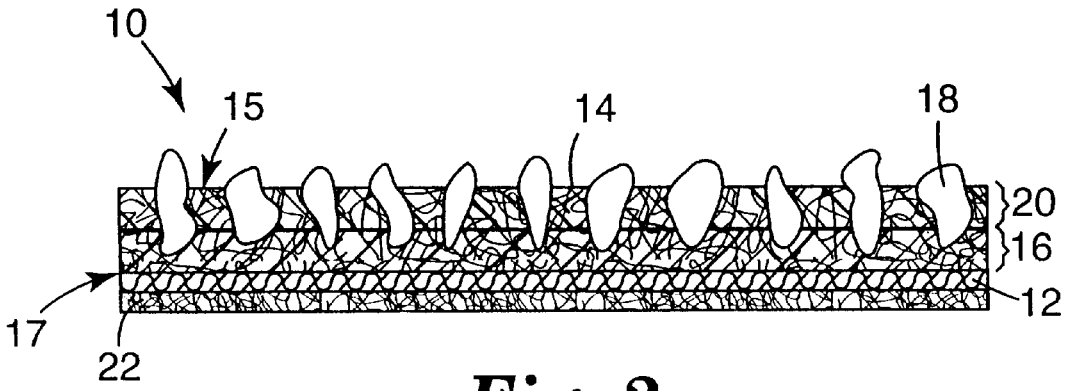
FIG. 2 is an enlarged side elevational view of the abrasive disc of FIG. 1.

The nonwoven web 14 is preferably reinforced and consolidated by needle tacking, a treatment which mechanically strengthens the nonwoven web by passing barbed needles therethrough. During this treatment, the needles pull the fibers of the web with them while they pass through the nonwoven web so that, after the needle tacking operation, individual collections of fibers of the web are oriented in the thickness direction of the nonwoven fabric. The amount or degree of needle tacking may include the use of about 8 to about 20 needle penetrations per square centimeter of web surface when 15×18×25×3.5 RB, F20 6-32-5.5B/3B/2E/L90 needles (commercially available from Foster Needle Company, Manitowoc, Wis.) are used. Needle tacking is readily accomplished by use of a conventional needle loom which is commercially available from, for example, Dilo, Inc. of Charlotte, N.C.

Where the web is to be incorporated into machine driven abrasive articles such as endless belts or abrasive discs, the above described backing 12 is applied to one of the major surfaces of the nonwoven web 14 prior to the needle tacking operation. The action of the needles in the needle tacking operation serves to affix the backing 12 to the nonwoven web 14 in a known manner. Although additional adhesive can be used to bond the backing 12 and the web 14, the needle tacking operation is generally sufficient in securing these materials to one another. The above described degree of needle tacking provides an article in which about 60% of the fiber thickness is above the backing 12 and about 40% of the fiber thickness is below the backing 12, as indicated by reference numeral 17 in FIG. 2. Suitable belts can be obtained when the thickness ratio of fiber above the scrim to fiber below the scrim is from about 0.75 to 3, preferably from about 1.0 to 1.7.

After completion of the needle tacking operation, an additional layer (not shown) comprising a suitable polymer may then be applied over the exposed surface of the backing 12 in the manner described in commonly assigned U.S. Pat. No. 5,482,756, issued Jan. 9, 1996. In the manufacture of abrasive wheels, the foregoing polymer backing is generally not included within the construction of the article.

A prebond resin is typically used to bond the fibers in the web 14 to one another at their mutual contact points. The prebond resin preferably comprises a coatable resinous adhesive which, upon hardening by thermal curing or the like, forms an adhesive layer to hold the fibers of the web 14 to one another. Any of a variety of known materials may be used as a prebond resin including those described below. Preferred are materials which, upon hardening, form tough, flexible, rubbery or elastomeric binders. Preferred prebond resins include materials such as polyurethanes, polyureas, styrene-butadiene rubbers, nitrile rubbers, and polyisoprene. Polyurethanes or polyureas are more preferred, and preferred polyurethanes include those resulting from the reaction of an isocyanate with a polyol, such as is available in precursor form from Uniroyal Chemical Co. under the trade designation "BL-16". The prebond resin is applied to the web in a relatively light coating, typically one which provides a dry add-on weight of at least about 200 g/m$^2$. However, those skilled in the art will appreciate that the selection and amount of resin actually applied can depend on any of a variety of factors including, for example, the fiber weight in the nonwoven web, the fiber density, the fiber type as well as the contemplated end use for the finished article.

In addition to the prebond resin, make and size coat precursors are applied to the needletacked nonwoven web to provide first and second resin layers 16 and 20, respectively, within the article 10. An optional super size coat (not shown) may be included in the articles to provide a third resin layer, especially in the manufacture of endless belts, for example. The organic binders used as make coat precursor, size coat precursor and the optional super size coat precursor are typically applied to the needle tacked web in a flowable state and during the subsequent processing of the abrasive article, the binder precursors are converted to hardened, solid, non-flowable binders.

The foregoing make and size coat precursors and the optional super size coat precursor may comprise any of a variety of thermoplastic materials. Alternatively, the binders can be formed from materials that are capable of being crosslinked. It is also within the scope of this invention to have a mixture of thermoplastic binder and crosslinked binder. In the use of crosslinkable binder precursors, the binder precursor is exposed to an appropriate energy source to initiate polymerization or curing and to thereby form the hardened binder.

Suitable crosslinkable organic polymeric binder precursors can comprise either condensation curable resins or addition polymerizable resins. The addition polymerizable resins can be ethylenically unsaturated monomers and/or oligomers. Examples of crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures of any of the foregoing.

Phenolic resins are widely used as abrasive article binders because of their desired thermal properties, availability, cost and ease of handling. Resole phenolic resins have a molar ratio of formaldehyde to phenol of greater than or equal to one, typically between 1.5:1.0 to 3.0:1.0. Novolac phenolic resins have a molar ratio of formaldehyde to phenol of less than 1.0:1.0. Examples of commercially available phenolic resins include those known by the trade names "Durez" and "Varcum" from Occidental Chemicals Corp.; "Resinox" from Monsanto; "Arofene" from Ashland Chemical Co. and "Arotap" from Ashland Chemical Co.

Examples of latex resins that can be mixed with phenolic resin include acrylonitrile butadiene emulsions, acrylic emulsions, butadiene emulsions, butadiene styrene emulsions and combinations thereof. These latex resins are commercially available from a variety of different sources and include those available under the trade designations "Rhoplex" and "Acrylsol" commercially available from Rohm and Haas Company, "Flexcryl" and "Valtac" commercially available from Air Products & Chemicals Inc., "Synthemul" and "Tylac" commercially available from Reichold Chemical Co., "Hycar" and "Goodrite" commercially available from B. F. Goodrich, "Chemigum" commercially available from Goodyear Tire and Rubber Co., "Neocryl" commercially available from ICI, "Butafon" commercially available from BASF and "Res" commercially available from Union Carbide.

Epoxy resins have an oxirane group and are polymerized by ring opening. Such epoxide resins include monomeric epoxy resins and polymeric epoxy reins. These resin can vary greatly in the nature of their backbones and substituent groups. For example, the backbone may be of any type normally associated with epoxy resins and substituent groups thereon can be any group free of an active hydrogen atom that is reactive with an oxirane group at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol A)] and commercially available materials under the trade designations "Epon 828", "Epon 1004" and "Epon 1001F" available from Shell Chemical Co., "DER-331", "DER-332" and "DER-334" available from Dow Chemical Co. Other suitable epoxy resins include glycidyl ethers of phenol formaldehyde novolac (e.g., "DEN-431" and "DEN-428" available from Dow Chemical Co.

Examples of ethylenically unsaturated binder precursors include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

Aminoplast binder precursors have at least one pendant alpha, beta-unsaturated carbonyl group per molecule or oligomer. These materials are further described in U.S. Pat. Nos. 4,903,440 and 5,236,472, both incorporated herein after by reference.

Ethylenically unsaturated monomers or oligomers may be monofunctional, difunctional, trifunctional or tetrafunctional or even higher functionality. The term "acrylate", as used herein, is intended to include both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthryitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274, incorporated by reference herein. A preferred isocyanurate material is a triacrylate of tris(hydroxy ethyl) isocyanurate.

Acrylated urethanes are diacrylate esters of hydroxy terminated isocyanate extended polyesters or polyethers. Examples of commercially available acrylated urethanes include those available under the trade designations "UVITHANE 782", available from Morton Chemical, and "CMD 6600", "CMD 8400", and "CMD 8805", available from UCB Radcure Specialties. Acrylated epoxies are diacrylate esters of epoxy resins, such as the diacrylate esters of bisphenol A epoxy resin. Examples of commercially available acrylated epoxies include those available under the trade designations "CMD 3500", "CMD 3600", and "CMD 3700", available from UCB Radcure Specialties.

Acrylated urethanes are diacrylate esters of hydroxy terminated NCO extended polyesters or polyethers. Examples commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Examples of ethylenically unsaturated diluents or monomers can be found in U.S. Pat. No. 5,236,472 (Kirk et al.) and in co-pending U.S. application Ser. No. 08/474,289 Larson et al.); the disclosures of both patent applications are incorporated herein after by reference. In some instances these ethylenically unsaturated diluents are useful because they tend to be compatible with water.

Additional details concerning acrylate dispersions can be found in U.S. Pat. No. 5,378,252 (Follensbee), incorporated by reference herein.

It is also within the scope of this invention to use a partially polymerized ethylenically unsaturated monomer in the binder precursors used herein. For example, an acrylate monomer can be partially polymerized and incorporated into an abrasive slurry (e.g. a slurry of binder precursor with abrasive particles). The degree of partial polymerization should be controlled so that the resulting partially polymerized ethylenically unsaturated monomer does not have an excessively high viscosity so that the resulting abrasive slurry can be coated to form the abrasive article. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

Referring to the make coat or first resin layer 16, a make coat precursor is applied to nonwoven web 14, principally to serve as an adhesive for abrasive particles. Preferably, make coat 16 forms a discrete adhesive layer adjacent to the surface of backing 12 and most preferably make coat 16 is in contact with the surface of backing 12 at the interface of second major web surface 17 and backing 12. The make coat precursor is applied to web 14 so that the hardened coating is essentially continuous and extends from the backing 12, engulfing web 14 with fibers from the web extending above the hardened make coat as well as below backing 12. Some discontinuity in the make coat 16 is acceptable and may result from entrapped air when the make coat precursor is applied over the fibers of the nonwoven web 14.

Suitable make coat precursors for use herein include the materials described above. Preferably, the make coat precursor is selected from phenolic resins and epoxy resins capable of forming a hard, brittle binder having a Knoop hardness of at least about 20 kg/mm$^2$. Phenolic resins are most preferred in the formation of the make coat for the articles of the present invention. A particularly preferred phenolic resin is a resole formaldehyde/phenol condensate of a molar ratio 1.96:1 (formaldehyde:phenol) that is catalyzed by sodium hydroxide. Suitable resins are typically 70% solids in water and may be obtained from commercial sources such as, for example, Neste, Inc. of Missasaqua, Ontario, Canada. The make coat precursor is applied to web 14 to provide a dry coating weight for the resulting make coat 16 of at least about 400 g/m$^2$, preferably at least about 600 g/m$^2$ and most preferably at least about 800 g/m$^2$.

Abrasive particles are adhered within the make coat to impart a desired abrasive character to the finished article. There are two main types of abrasive particles, inorganic abrasive particles and organic based particles. Inorganic abrasives particles can further be divided into hard inorganic abrasive particles (e.g., having a Moh hardness greater than 8) and soft inorganic abrasive particles (e.g., having a Moh hardness less than 8).

Examples of conventional hard inorganic abrasive particles include fused aluminum oxide, heat treated aluminum oxide, white fused aluminum oxide, ceramic aluminum oxide materials such as those commercially available under the trade designation "Cubitron" (available from Minnesota Mining and Manufacturing Company, St. Paul, Minn.), black silicon carbide, green silicon carbide, titanium diboride, boron carbide, tungsten carbide, titanium carbide, diamond, cubic boron nitride, garnet, fused alumina zirconia, sol gel abrasive particles and the like. Examples of sol gel abrasive particles can be found in U.S. Pat. Nos. 4,314,827, 4,623,364; 4,744,802, 4,770,671; 4,881,951, all incorporated herein after by reference. It is also contemplated that the abrasive particles could comprise abrasive agglomerates such as those described in U.S. Pat. 4,652,275 and 4,799,939, the disclosures of which are incorporated herein by reference.

Examples of softer inorganic abrasive particles include silica, iron oxide, chromia, ceria, zirconia, titania, silicates and tin oxide. Still other examples of soft abrasive particles include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), aluminum oxide, titanium dioxide) and metal sulfites (such as calcium sulfite), metal particles (tin, lead, copper and the like) glass particles, glass spheres, glass bubbles, flint, talc, emery, and the like.

Organic based particles include plastic abrasive particles formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon and combinations thereof. Preferred thermoplastic polymers are those possessing a high melting temperature and/or having good heat resistance properties. In the formation of thermoplastic particles, the polymer material may be formed into elongate segments (e.g., by extrusion) and cut into the desired length. Alternatively, thermoplastic polymer can be molded into a desired shape and particle size by, for example, compression molding or injection molding.

Organic abrasive particles can also comprise a crosslinked polymer such as those resulting from the polymerization of phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins and mixtures thereof. These crosslinked polymers can be made, crushed and screened to the appropriate particle size and particle size distribution.

The articles of the invention may contain a mixture of two or more different abrasive particles such as a mixture of hard inorganic abrasive particles and soft inorganic abrasive particles or a mixture of two soft abrasive particles. In the mixture of two or more different abrasive particles, the individual abrasive particles may have either similar average particle sizes or the individual abrasive particles may have a different average particle sizes. In yet another aspect, there may be a mixture of inorganic abrasive particles and organic abrasive particles.

The abrasive particles may be present within the finished article at a weight ranging from 600 g/m$^2$ to 2,000 g/m$^2$ and preferably about 1500 g/m$^2$. Typical sizes for the particles (e.g., average particle diameter) may range from about 1 micrometer to about 10 millimeters.

A size coat 20 or second resin layer is applied to the article 10 over the foregoing make coat and abrasive particles. The size coat is applied to web 14 as a size coat precursor to form a hard, brittle binder preferably having a Knoop hardness of at least about 20 kg/mm$^2$. The size coat precursor is applied to the web 14 so that the hardened size coat is preferably essentially continuous and extends above the make coat, essentially sandwiching the make coat between the backing 12 and the size coat. Some discontinuity in the size coat 20 is acceptable and may result from entrapped air when the size coat precursor is applied over the fibers of the nonwoven web 14. The size coat 20 typically extends from the upper surface of the make coat through the nonwoven web. Fibers from the web may extend above and below the hardened size coat and abrasive particles 18 are preferably substantially covered by size coat 20, although portions of the particles may protrude above the outermost surface of the coat 20. Suitable size coat precursors include the materials described above. Preferably, the size coat precursor is selected from phenolic resins and epoxy resins. Of these, phenolic resins are preferred and a particularly preferred phenolic resin is the formaldehyde/phenol condensate described above in the description of the make coat. The size coat precursor is applied to the web to provide a dry coating weight for the resulting size coat of at least about 400 g/m$^2$, preferably at least about 600 g/m$^2$ and most preferably at least about 800 g/m$^2$.

Optionally, a super size coat may be included in the construction of the articles of the invention, especially in the manufacture of endless belts. When included, the super size is applied to the article as a super size precursor over the aforementioned size coat. The subsequently hardened super size coat is present in the article at a dry coating weight of at least about 150 g/m$^2$ and preferably at least about 200 g/m$^2$. Suitable materials for the super size coat include the materials described above, and preferably are selected from the same materials as those mentioned above for the prebond resin.

The foregoing binder precursors may further comprise optional additives, such as, abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, suspending agents and the like in amounts suitable to provide the properties desired. The selection of appropriate additives and the amounts thereof may readily be determined by those skilled in the art.

The addition of a suitable plasticizer can increase the erodibility of the abrasive coating and soften the overall binder hardness. The plasticizer should be in compatible with the binder precursor to avoid phase separation when the precursor is still in a coatable or liquid state. Examples of possible plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyol derivatives, t-butylphenyl diphenyl phosphate, tricresyl phosphate, castor oil, combinations thereof and the like.

A filler typically comprises a particulate material and generally has an average particle size range between 0.1 to 50 micrometers, typically between 1 to 30 micrometers. Examples of useful fillers include metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), aluminum oxide, tin oxide (e.g. stannic oxide), titanium dioxide) and metal sulfites (such as calcium sulfite), thermoplastic particles (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides. It will be understood that the above fillers constitute a representative sampling and not a complete list of possible fillers for use herein.

Examples of antistatic agents include graphite, carbon black, vanadium oxide, conductive polymers, humectants, and the like. These antistatic agents are disclosed in U.S. Pat. Nos. 5,061,294; 5,137,542, and 5,203,884, incorporated herein after by reference.

The foregoing binder precursors may further comprise a curing agent to initiate and complete the polymerization or crosslinking process required in the conversion of the binder precursor into a binder. The term curing agent encompasses initiators, photoinitiators, catalysts and activators. The amount and type of the curing agent will depend largely on the chemistry of the binder precursor, as known by those skilled in the art.

The abrasive articles of the present invention may be in sheet form or may be cut into circular discs, as illustrated by the article 10 of FIG. 1. Additionally, the ends of a length of the abrasive composition may be spliced together in a known manner to provide an endless belt. Sheets of the foregoing nonwoven web may be stacked together with or without additional binder to form a wheel or brush product, or previously-cut discs may be ganged together with an optional binder. The preferred abrasive article of the present invention is in a disc form, typically provided with diameters ranging from about 2 cm to about 20 cm and are usefully employed with a right-angle power tool with a suitable attachment means. The inventive discs may be attached to such tools via a center arbor hole, pressure-sensitive adhesive means, or by the use of so-called "hook-and-loop" mechanical fasteners.

The nonwoven abrasive articles of the invention may be prepared by first providing a nonwoven web. The web may be a commercially available web or one which is manufactured specifically for use in the articles of the invention. In the manufacture of discs and endless belts, the backing (e.g., scrim) is applied to a major surface of the web and a needletacking operation is performed to consolidate or density the web. Needletacking serves to affix the web to the backing by driving portions of at least some of the web fibers through the backing where they are retained to hold the web to the backing. Thereafter, a prebond coating is applied to the web in an amount sufficient to provide a dry add-on weight of at least about 200 g/m$^2$. The prebond coating may be applied in any known manner in order to bond at least a majority of the web fibers to one another. A preferred method for the application of the prebond coating is through the use of a conventional two roll coater. The prebond resin is then hardened, typically by heat curing to provide a prebonded web. The prebonded web may be rolled or otherwise formed in a manner convenient for subsequent processing as described herein.

A make coat precursor is then applied to the prebonded web to provide a dry add-on weight of at least about 400 g/m$^2$, typically more than 600 g/m$^2$ and preferably more than 800 g/m$^2$. The make coat precursor is preferably applied to the prebonded web in a manner which causes the precursor to penetrate the fibrous web and, when hardened, form a make coat at the interface between the web's second major surface and the surface of the backing. A suitable method for the application of the make coat precursor is through the use of a metering roll wherein the prebonded web is dipped through a bath of liquid precursor and then directed through a pair of driven nip rolls preset to provide sufficient pressure to the coated web so that the desired dry add-on weight for the make coat is achieved.

Abrasive particles may be applied to the flowable surface of the make coat precursor. The particles are preferably applied in a relatively uniform distribution across the surface of the make coat precursor to provide a dry add-on weight of at least about 400 g/m$^2$. The abrasive particles can be applied to the make coat precursor by blowing, dropping or electrostatically coating the particles onto the uncured make coat precursor. It will be appreciated that abrasive particles can also be mixed into the make coat precursor and both the make coat precursor and the abrasive particles can be applied to the prebonded web as a binder/abrasive slurry in a single coating step identical to that described above. When the make coat precursor already includes abrasive particles, additional abrasive particles can be added (e.g., by drop coating) to provide an additional loading of particles at the surface of the make coat precursor prior to curing. The make coat precursor is then at least partially cured in an appropriate manner such as by conventional thermal curing methods or by exposure to ultraviolet radiation where a suitable photoinitiator has been added to the composition of the make coat precursor.

The size coat precursor is then applied over the at least partially cured make coat precursor to provide a dry add-on of at least about 400 g/m$^2$, typically more than 600 g/m$^2$ and preferably more than 800 g/m$^2$. The size coat precursor is preferably applied to the prebonded web in a manner similar and preferably identical to that used for the application of the make coat precursor to cause the size coat precursor to penetrate the fibrous web and, when hardened, form a size coat at the outermost surface of the at least partially cured make coat. A metering roll, as described above, may be used in the application of the size coat precursor to provide a desired dry add-on weight for the size coat. The size coat precursor and the least partially cured make coat may then be exposed to conditions to harden both of the precursor resins.

In the manufacture of endless belts, an optional super size coat precursor may be applied over the size coat. The super size coat precursor is added to the article in an amount sufficient to provide a dry add-on weight of at least about 200 g/m$^2$. The super size coat precursor is preferably applied to the size coat by spraying the precursor over the size coat in a known manner to provide the desired dry add-on weight. The super size coat is then hardened by thermal curing of the precursor or by a radiation induced cure of the precursor material (e.g., by ultraviolet radiation). In the foregoing composite articles, the abrasive particle to total binder weight ratio is preferably at least about 5:1 and the total binder to fiber weight ratio is preferably at least about 1.5 to 1. In this context, "total binder" refers to the combined dry weights of the foregoing prebond, make coat, size coat and optional super size coat.

The composite product can then be further processed to provide finished articles suitable for use in surface finishing applications. The composite can be used to provide articles in the form of endless belts, discs, hand pads and the like. Discs and hand pads can be prepared by cutting (e.g., die cutting) the articles from the composite in a known manner. In the formation of endless belt, strips are cut from the composite having a length and a width suitable for the formation of endless belts that will fit on an abrasive belt sander, for example. Conventional splicing techniques may be employed in the formation of the finished belt. One such technique, known as a butt splice, generally requires that the ends of the composite strips be angled in a mating configuration, and the ends may then be spliced using a conventional urethane splicing adhesive and a heated belt splicing technique. Of course, other belt forming techniques may be employed such as conventional coated abrasive belt manufacturing techniques and adhesives. The preparation of endless belts, discs, hand pads and the like is within the skill of those practicing in the field, and the invention is not to be construed as limited to providing belts or the like that have been prepared by any specific preparative method.

In addition to the foregoing endless belts, discs and hand pads, abrasive wheels may be provided. In the formation of such wheels, the foregoing process is followed except that the scrim backing (e.g., numeral 12 of FIG. 2) is not included in the formation of the composite and the composite may be formed into wheels prior to final curing of the binder precursors. Annuli resembling the shape of the article 10 of FIG. 1 are cut from the composite and concentric stacks dried but uncured annuli may be mounted onto a shaft. The number of annuli used in the formation of such wheels typically ranges from 2 to 10. The stacked annuli are compressed to a suitable thickness (e.g., any thickness that meet end user needs) and the binder precursors of the compressed stack of annuli are hardened by heating, for example. Hardening of the precursors is typically and preferably carried out slowly to allow for the removal of solvent and to ensure sufficient hardening of the precursors. For example, a stack of 5 or 6 annuli are typically cured in an oven for about 3 hours at 91° C. Thereafter, the oven temperature may be raised to 121° C. for an additional 5 hours. The compressed composite is allowed to cool to room temperature and is then removed from the shaft. A core material (e.g., polyurethane) may be cast into the internal diameter of the annulus. The resulting abrasive article is then dressed on a lathe to assure that the outer diameter of the finished wheel is concentric to the internal diameter.

MATERIALS

In the Examples below, materials are identified according to certain abbreviations or trade designations.

| | |
|---|---|
| Irgacure 651 | is a free radical initiator, available from Ciba-Geigy Corp., Greensboro, N.C. |
| BAM | is an aminoplast resin with at least 1.1 pendant α, β-unsaturated carbonyl groups and prepared similar to preparation 2 disclosed in U.S. Pat. No. 4,903,440. |
| PR | is a resole phenolic resin precursor comprising a 70% solids condensate of a 1.5786:1.0 formaldehyde:phenol mixture with 0.07% sodium hydroxide catalyst added based on weight of phenol. |
| CMS | is a calcium metasilicate filler, commercially available from NYCO, Willsboro, NY. under trade designation "WOLLASTOKUP" |
| CACO | is a powdered, untreated, calcium carbonate, available from J. M Huber Corp., Engineered Minerals Division, Atlanta, Georgia. |
| ADIPRENE BL31 | is the trade designation for a poly(tetramethylene glycol) polymer reacted with two moles of toluene diisocyanate to produce difunctional isocyanate prepolymer which is subsequently blocked with methyl ethyl ketoxime. The material is commercially available from Uniroyal chemical Co. Inc. |
| PMA | is propylene glycol monoethyl ether acetate obtained from Ashland Chemical Inc. of Columbus, Ohio. |
| CUBITRON | is the trade designation for a ceramic aluminum oxide abrasive material commercially available from Minnesota Mining and Manufacturing Company of St. Paul, Minnesota. |
| NZ ALUNDUM | is the trade designation for an aluminum zirconia abrasive grain commercially available from Norton Company, Worcester, Massachusetts. |
| POLYSOLV | is the trade designation for propylene glycol monomethyl ether acetate commercially available from Ashland Chemical Inc. of Columbus, Ohio. |
| CAB-O-SIL | is the trade designation for silicon dioxide, used as a thickener, commercially available from Cabot Corp. of Boston Massachusetts. |

TEST METHODS

The following test procedure was employed in evaluating the articles of the Examples.

Steel Ring Grinding Test

This test provided an automated means for evaluating abrasive articles of the invention in a variety of use conditions. In this test, the workpiece was a milled steel ring of outside diameter 30.5 cm, inside diameter 28.0 cm, and a thickness of between 5 and 11 cm. The ring was mounted on a rotating table which turned at 45 rpm. The abrasive disc to be tested was mounted on a 17.8 cm diameter hard back-up pad with a 10.2 cm hub, available commercially under Part Nos. 05144-45192 and 51144-45190, respectively, from Minnesota Mining and Manufacturing Company, St. Paul, Minn. The disc/back-up pad assembly was then mounted on an electric grinder capable of rotating the disc at 5000 rpm (under zero load). The grinder was in turn mounted on a constant load device known under the trade designation "MECHANITRON CFD 2100", from Mechanitron Corporation, Roseville, Minn. which assured the application of a 4.54 kg load on the abrasive disc against the ring workpiece. The positioning of the abrasive disc/back-up pad/constant load device assembly was provided by mounting the assembly on a robot known under the trade designation "Type T3 Industrial Robot", previously available from Cincinnati Milacron, Industrial Robot Division, Greenwood, S.C. The grinder assembly was positioned to abrade the ring at about the 3 o'clock position along its surface.

At the start of each test, the ring was weighed and the initial surface finish (arithmetic average ($R_a$) of the scratch depth) was determined using a profilometer commercially available under the trade designation "Surtronic 3" from Taylor Hobson, Leicester, England. The ring was then returned to the rotating table. Prior to mounting the abrasive disc to be tested on the back-up pad, the disc was weighed. The robot positioned the driven abrasive disc so that it was operated on the flat face of the ring and was tilted at an approximate 6 degree(s) angle out of plane of the ring and about an axis defined by a radius of the ring so that the disc was "heeled" and slightly flexed by its contact with the ring surface. Each disc tested was operated in this position for 1 minute.

Each disc tested was then rotated +10 degree(s) about an axis essentially parallel to the ring tangent so that the outside edge of the ring was contacted and the test continued for 30 seconds.

Each disc tested was then rotated −10 degree(s) so that again the flat face was contacted for 1 minute, and then rotated an additional −10 degree(s) so that the inside edge of the ring was contacted for 30 seconds.

The 4-minute test cycle in each case was completed by rotating the disc +10 degree(s) to again contact the flat face of the ring for a final 1 minute of grinding. In some of the tests the ring weight, abrasive disc weight, and workpiece finish were determined after each 4-minute cycle. The test continued for a total of 20 4-minute cycles or until the disc failed by no longer effectively abrading the workpiece, i.e., there was no further abrasive left on the disc.

Upon completion of the test cycles, the workpieces were weighed to determine the amount of workpiece material removed (cut), the abrasive disc weighed to determine the amount of abrasive remaining, and the final surface finish measured.

PREPARATIVE PROCEDURE

Scrim Reinforced Nonwoven Web

Unless stated otherwise, the articles described in the Examples were prepared according to the following procedure.

A 102 cm wide lofty, open, nonwoven air laid web of a 75/25 blend of 3.8 cm 70 denier per filament and 5.1 cm 58 denier per filament oriented nylon 66 fibers was prepared by (1) initially blending and opening the fibers with a weighfeeder (commercially available from the Procter and Schwartz Company) and then with a fiber opener (commercially available from the Dilts and Kennedy Company) to provide a lofty mass of fibers. The finished air laid web was made by first forming an unbonded air laid mat using a Rando Weber machine (commercially available from the Curlator Corporation). The air laid mat typically had a weight within the range 272 g/m$^2$ to 297.5 g/m$^2$. The mat was placed upon a major surface of a 16 inch×16 inch (40.6 cm ×40.6 cm) plain weave nylon mesh scrim comprised of yarn having a linear density of 840 denier (commercially available from the Burlington Industrial Fabrics Company). The combined article was then passed through a needle tacking machine (commercially available from Dilo, Inc. of Charlotte, N.C.) at a rate of 1.5 meters per minute. The needle tacking machine was fitted with a needle board having 23 rows of needles spaced 1.1 cm apart with a distance between needles in a single row of 1.3 cm. The needle board was fitted with 15×18×25×3.5 RB needles (commercially available from Foster Needle Company, Manitowoc, Wis.) and was operated at a rate of 175 punches per minute with a 2.2 cm penetration depth. The resultant composite structure had about 60 percent of its thickness above the center line of the scrim cloth and about 40 percent of its thickness below the center line. The needled fibers were mechanically interlocked to the scrim and could not be removed without destroying the scrim.

The needled composite was then impregnated with a prebond resin precursor by passing it through a two roll coater to provide a dry add-on weight of about 419 g/m$^2$. The prebond precursor was formulated as set forth below.

Prebond Resin Precursor

| Component | weight % |
|---|---|
| 65% PMA/35% methylene dianiline | 17.24 |
| lithium stearate premix[1] | 4.38 |
| ADPRENE BL-16[2] | 50 |
| brown pigment | 1.65 |
| calcium carbonate | 19.66 |
| PMA | 7.07 |

[1] 41% dispersion of lithium stearate in POLYSOLV solvent, commercially available from Witco Corp., Chicago, Illinois.
[2] Trade designation for a designation for a blocked polyfunctional isocyanate polymer from Uniroyal Chemical Company, Inc. of Middlebury, Connecticut.

The prebond resin precursor was cured by placing the coated web in an oven at 135° C. for a period of about 5 minutes. Circular sections having diameters of about 17.8 cm were cut from the scrim backed web for use in making abrasive discs for the Examples.

EXAMPLES

The features of the invention are further illustrated in the following non-limiting Examples. Unless otherwise indicated, all parts and percentages are by weight.

COMPARATIVE EXAMPLE A

This article was a surface conditioning disc comprising a scrim backed nonwoven web having a 50/50 mixture of grades 60 and 80 aluminum oxide abrasive grain. The urethane prebond had a dry weight between 352 and 486 g/m$^2$. A phenolic make coat and the foregoing mineral combined to provide a dry add-on weight between 1299 and 1383 g/m$^2$. A urethane size coat provided a dry add-on weight of about 168 g/m$^2$.

Example 1

A surface conditioning disc was prepared with a precut 17.8 cm diameter disc prepared according to the foregoing preparative procedure. Make coat precursor was applied on a scrim reinforced nonwoven backing by gravure coating with a notch bar to meter the amount of resin precursor applied to the roll. The disc was run face down on the roll and the make coat precursor was applied to the top side of the backing to achieve a dry add-on weight of 1075 g/m$^2$. The make coat precursor comprised of a 90% solids blend of 51% PR, 22% BAM, 1% photoinitiator (Irgacure 651), 4% calcium carbonate (CACO), 22% CMS. Grade 60 aluminum oxide abrasive grain was electrostatically projected into the uncured make coat precursor to provide an add-on weight of 806 g/m$^2$. The coated backing was passed under ultraviolet light bulbs for a sufficient time to cause partial curing of the make coat precursor to thereby maintain the orientation of the abrasive grains in the make coat precursors under moderate deformation pressure. The resulting disc was thermally cured for 120 minutes at 90° C. to eliminate moisture and then for an additional 6 hours at 121° C. to harden the resin. Then disc was flexed to uniformly crack the abrasive /adhesive coating in two perpendicular directions along the upper surface of the article by passing the disc between first and second roller pairs, each pair consisting of a weighted steel roller and a rubber roller. The roller pairs were adjusted to provide a sufficient gap to allow the disc to pass between the rollers while applying sufficient pressure to crack the resin. A polyurethane size coat precursor was applied over the abrasive grains with to provide a dry add-on weight of 215 g/m$^2$. The polyurethane size coat precursor was a 38% solid blend comprised of 15% of a 65% PMA/35% methylene dianiline solution, 36% blocked isocyanate prepolymer (Adiprene BL-31) and 49% PMA. The size coat precursor was cured for 30 minutes at 148° C. The binder to web weight ratio was 4.1 and the mineral to binder weight ratio was 0.7.

Example 2

A surface conditioning disc was prepared as in Example 1 except that grade 60 aluminum zirconia (NZ ALUNDUM) abrasive grain was used to provide an add-on weight of 806 g/m$^2$, and the size coat precursor was the same resin as the make coat precursor to provide a size coat having a dry add-on of 1075 g/m$^2$. A polyurethane super size coat was applied over the abrasive grains to provide a super size coat with a dry add-on weight of 215 g/m$^2$. The super size coat was a 38% solid blend comprised of 15% of a 65% PMA/35% methylene dianiline solution, 36% blocked isocyanate prepolymer (Adiprene BL-31) and 49% of PMA. The super size coat was cured for 30 minutes at 148° C. The binder to web weight ratio was 6.7 and the mineral to binder weight ratio was 0.4.

Example 3

An abrasive disc was prepared as in Example 2 except that the size coat was applied on the top of the mineral to provide an add-on weight of 950 g/m$^2$. The size coat was a 79% solid blend comprising 50% PR, 41% calcium carbonate (CACO) and 9% of an 80/20 solution of water and propylene glycol monomethyl ether acetate (POLYSOLV). A polyurethane super size precursor was applied over the abrasive grains to provide an add-on weight of 215 g/m$^2$. The super size coat precursor was a 38% solid blend comprised of 15% of a 65% PMA/35% methylene dianiline solution, blocked isocyanate prepolymer (Adiprene BL-31) and 49% PMA. The super size precursor was cured for 30 minutes at 148° C. The binder to web weight ratio was 5.6 and the mineral to binder weight ratio was 0.5.

Example 4

A surface conditioning disc was prepared. A make coat precursor was prepared comprising CUBITRON mineral and a phenolic resin precursor. The make coat precursor slurry was applied on to a scrim reinforced nonwoven backing as in Example 1 to provide a dry add-on weight (resin plus abrasive) of 1130 g/m$^2$. The make coat precursor was a 94% solid blend comprised of 29% PR, 12% BAM, 1% photoinitiator (Irgacure 651), 23% calcium carbonate (CACO), 12% CMS and 23% CUBITRON mineral (80 grade). Additional grade 80 CUBITRON mineral was electrostatically projected into the make coat precursor to provide an add-on weight of 806 g/m$^2$. The coated backing was passed under ultraviolet light bulbs for a sufficient time to cause partial curing of the make coat precursor to thereby maintain the orientation of the abrasive grains resin under moderate deformation pressure. The resulting disc was thermally cured for 120 minutes at 90° C. and for 6 hours at 121° C. Then disc was flexed to uniformly crack the abrasive/adhesive coating in two perpendicular directions along the upper surface of the article by passing the disc between first and second roller pairs, each pair consisting of a weighted steel roller and a rubber roller. The roller pairs were adjusted to provide a sufficient gap to allow the disc to pass between the rollers while applying sufficient pressure to crack the resin. A size coat precursor was applied on the top of the mineral to provide a dry add-on weight of 935 g/m$^2$. The size coat precursor was a 77% solids blend comprised of 49% PR, 41% calcium carbonate (CACO) and 11% of an 80/20 solution of water/propylene glycol monomethyl ether acetate (POLYSOLV). The disc was cured for 180 minutes at 90° C. and for 6 hours at 121° C. The binder to web weight ratio was 3.8 and the mineral to binder weight ratio was 1.1.

Example 5

A slurry of 80 grade CUBITRON grain and phenolic resin make coat precursor was prepared and applied to a scrim reinforced nonwoven backing. The backing was prepared as in the preparative procedure above except that the backing material was not precut into discs. The make coat precursor/abrasive slurry was applied to the backing material by dipping the backing in the resin precursor/mineral slurry and then passing the backing between two rubber rolls to squeeze excess resin from the backing and to provide a dry add-on weight of 1600 g/m$^2$. The make coat precursor was an 85% solids blend comprised of 40% PR, 32.5% calcium carbonate (CACO), 5% of an 80/20 solution of water/propylene glycol monomethyl ether acetate (POLYSOLV), 0.5% silicon dioxide (CAB-O-SIL) and 22% grade 80 Cubitron mineral. Additional grade 80 Cubitron mineral was blown on to the make coat precursor to provide an additional add-on weight of 900 g/m$^2$. The mineral coated backing was passed through a spray booth to add a size coat precursor over the mineral to provide a dry add-on weight of 1000 g/m$^2$. The size coat precursor was an 80% solids blend comprised of 50% PR, 42%, calcium carbonate (CACO) and 9% of an 80/20 solution of water/propylene glycol monomethyl ether acetate (POLYSOLV). The web was cut into sheets and thermally cured for 180 minutes at 90° C. and then for an additional 6 hours at 121° C. The binder to web weight ratio was 4.2 and the mineral to binder weight ratio was 1.2.

Example 6

A slurry of 50 grade CUBITRON grain and phenolic resin make coat precursor was prepared and applied to a scrim reinforced nonwoven backing. The backing was prepared as in the preparative procedure above except that the backing material was not precut into discs. The make coat precursor/abrasive slurry was applied to the backing material by dipping the backing in the resin precursor/mineral slurry and then passing the backing between two rubber rolls to squeeze excess resin from the backing and to provide a dry add-on weight of 1600 g/m$^2$. The make coat precursor was an 85% solids blend comprised of 40% PR, 32.5% calcium carbonate (CACO), 5% of an 80/20 solution of water/propylene glycol monomethyl ether acetate (POLYSOLV), 0.5% silicon dioxide (CAB-O-SIL) and 22% grade 80 Cubitron mineral. Additional grade 50 Cubitron mineral was blown on to the make coat precursor to provide an additional add-on weight of 900 g/m$^2$. The mineral coated backing was passed through a spray booth to add a size coat precursor over the mineral to provide a dry add-on weight of 1000 g/m$^2$. The size coat precursor was an 80% solids blend comprised of 50% PR, 42%, calcium carbonate (CACO) and 9% of an 80/20 solution of water/propylene glycol monomethyl ether acetate (POLYSOLV). The web was cut into sheets and thermally cured for 180 minutes at 90° C. and for 6 hours at 121° C. The binder to web weight ratio was 4.2 and the mineral to binder weight ratio was 1.2

COMPARATIVE EXAMPLE A and EXAMPLES 1–6

The foregoing articles were tested according to the Steel Ring Grinding Test. The incremental results are tabulated in Table 1 with the cumulative data in Table 2.

TABLE 1

| | Cut Rate, g./8 minutes. | | | | | | |
|---|---|---|---|---|---|---|---|
| Time | C. Ex. A | Example 1 | Example 2 | Example 3 | Example 4 | Example 5 | Example 6 |
| 8 | 115 | 104 | 162 | 193 | 209 | 225 | 227 |
| 16 | 97 | 92 | 146 | 168 | 198 | 211 | 299 |
| 24 | 100 | 88 | 132 | 153 | 190 | 203 | 229 |
| 32 | 87 | 79 | 127 | 158 | 189 | 200 | 230 |
| 40 | 74 | 78 | 121 | 148 | 182 | 187 | 216 |
| 48 | 74 | 74 | 123 | 154 | 177 | 191 | 208 |
| 56 | 63 | 69 | 102 | 149 | 165 | 185 | 202 |
| 64 | 59 | 67 | 95 | 142 | 171 | 176 | 202 |
| 72 | 50 | 67 | 88 | 127 | 163 | 180 | 194 |
| 80 | 54 | 67 | 85 | 122 | 153 | 176 | 195 |
| 88 | 48 | 65 | 80 | 121 | 149 | 177 | 206 |
| 96 | 46 | 61 | 74 | 119 | 154 | 177 | 202 |
| 104 | 48 | 61 | 71 | 113 | 150 | 183 | 260 |

TABLE 1-continued

| Cut Rate, g./8 minutes. | | | | | | | |
|---|---|---|---|---|---|---|---|
| Time | C. Ex. A | Example 1 | Example 2 | Example 3 | Example 4 | Example 5 | Example 6 |
| 112 | 47 | 56 | 70 | 119 | 155 | 167 | 197 |
| 120 | 62 | 54 | 72 | 109 | 155 | 168 | 200 |
| 128 | 36 | 55 | 71 | 115 | 133 | 158 | 195 |
| 136 | 34 | 50 | 67 | 116 | 142 | 122 | 198 |
| 144 | | 49 | 69 | 112 | 442 | 119 | 194 |
| 152 | | 47 | 76 | 97 | 124 | 136 | 200 |
| 160 | | 44 | 65 | 97 | | 123 | 195 |
| 168 | | 35 | 65 | 114 | | 100 | 197 |
| 176 | | 32 | 66 | 94 | | 118 | 191 |
| 184 | | 36 | 63 | 61 | | 148 | 192 |
| 192 | | 32 | 68 | 63 | | 144 | 198 |
| 200 | | 34 | 74 | 78 | | 140 | 202 |
| 208 | | 33 | 71 | 42 | | 123 | 206 |
| 216 | | 32 | 76 | 32 | | 118 | 204 |
| 224 | | 33 | 81 | | | | 189 |
| 232 | | 31 | 69 | | | | 177 |
| 240 | | | 64 | | | | 162 |
| 248 | | | 55 | | | | 146 |
| 256 | | | | | | | 129 |

TABLE 2

| Cumulative disc cut (g) v. time (min). | | | | | | | |
|---|---|---|---|---|---|---|---|
| Time | C. Ex. A | Example 1 | Example 2 | Example 3 | Example 4 | Example 5 | Example 6 |
| 8 | 115 | 104 | 162 | 193 | 209 | 225 | 227 |
| 16 | 212 | 196 | 308 | 361 | 407 | 436 | 426 |
| 24 | 312 | 284 | 440 | 514 | 597 | 639 | 655 |
| 32 | 399 | 363 | 567 | 672 | 786 | 839 | 885 |
| 40 | 473 | 441 | 688 | 820 | 968 | 1026 | 1101 |
| 48 | 547 | 515 | 811 | 974 | 1145 | 1217 | 1309 |
| 56 | 610 | 584 | 913 | 1123 | 1310 | 1402 | 1511 |
| 64 | 669 | 651 | 1008 | 1265 | 1481 | 1578 | 1713 |
| 72 | 719 | 718 | 1096 | 1392 | 1644 | 1758 | 1907 |
| 80 | 773 | 785 | 1181 | 1514 | 1797 | 1934 | 2102 |
| 88 | 821 | 850 | 1261 | 1635 | 1946 | 2111 | 2308 |
| 96 | 867 | 911 | 1335 | 1754 | 2100 | 2288 | 2510 |
| 104 | 915 | 972 | 1406 | 1867 | 2250 | 2471 | 2710 |
| 112 | 962 | 1028 | 1476 | 1986 | 2405 | 2638 | 2907 |
| 120 | 1024 | 1082 | 1548 | 2095 | 2560 | 2806 | 3107 |
| 128 | 1060 | 1137 | 1619 | 2210 | 2693 | 2964 | 3302 |
| 136 | 1094 | 1187 | 1686 | 2326 | 2835 | 3086 | 3500 |
| 144 | | 1236 | 1755 | 2438 | 2977 | 3205 | 3694 |
| 152 | | 1283 | 1831 | 2535 | 3101 | 3341 | 3894 |
| 160 | | 1327 | 1896 | 2632 | | 3464 | 4089 |
| 168 | | 1362 | 1961 | 2746 | | 3564 | 4286 |
| 176 | | 1394 | 2027 | 2840 | | 3622 | 4477 |
| 184 | | 1430 | 2090 | 2901 | | 3830 | 4669 |
| 192 | | 1462 | 2158 | 2964 | | 3974 | 4867 |
| 200 | | 1496 | 2232 | 3042 | | 4114 | 5069 |
| 208 | | 1529 | 2303 | 3084 | | 4237 | 5276 |
| 216 | | 1561 | 2379 | 3116 | | 4355 | 5480 |
| 224 | | 1594 | 2460 | | | | 5669 |
| 232 | | 1625 | 2529 | | | | 5846 |
| 240 | | | 2593 | | | | 6008 |
| 248 | | | 2648 | | | | 6153 |
| 256 | | | | | | | 6282 |

COMPARATIVE EXAMPLE B

Abrasive grains were incorporated into coated abrasive articles using conventional coated abrasive making techniques. The backing used was a 0.76 mm thick vulcanized fiber backing having a nominal weight of 67 pounds (30.4 kg) per ream (each ream consisting of 480 9"×1" (22.9 cm×27.9 cm) sheets) available from NVF of Yorklyn, Del. A make coat precursor was prepared that consisted of 48 parts PR and 52 parts CACO. The make coat precursor was diluted to about 78% solids with an 80/20 blend of water and a glycol ether solvent. The make coat precursor was roll coated onto the front side of the backing to achieve a wet add-on of 149–162 g/m$^2$. Immediately afterwards, grade 50 alpha alumina-based abrasive grains comprising, on a theoretical oxide basis, about 1.2% MgO, about 1.2% $Nd_2O_3$, about 1.2% $La_2O_3$, about 1.2% $Y_2O_3$, and about 95.2% $Al_2O_3$ (commercially available under the trade designation "CUBITRON 321" from Minnesota Mining and Manufacturing Company, St. Paul, Minn.) were electrostatically coated onto the make coat precursor at a rate of 604 g/m$^2$. The resulting construction was placed in an oven initially set at room temperature and then the temperature was gradually increased to 92° C. at a rate of about 1° C./minute. Heating then continued for two hours at 92° C.

A size coat material was prepared that consisted of 32 parts PR, 66 parts cryolite grinding aid, and 2 parts iron oxide filler. The resulting size coat material was diluted to 75% solids with an 80/20 blend of water and glycol ether solvent. The cryolite was purchased from Washington Mills of Niagara, N.Y. under the trade designation "ABBUF" and had an average particle size of about 18–25 micrometers. The size coat material was roll coated over the abrasive grain to achieve a wet add-on of 483–503 g/m$^2$. The resulting construction was placed in an oven initially set at room temperature and then the temperature was gradually increased to 66° C. at a rate of about 1° C./minute. The construction was then heated for two hours at 66° C. Following this, the oven temperature was increased to 99° C. at a rate of about 0.5° C./minute and heated for 12 additional hours.

After curing and cooling to room temperature, 7-inch (17.8 cm) diameter discs were die-cut from the foregoing material. The discs were then flexed in both directions using a conventional roll flexer.

COMPARATIVE EXAMPLE C

Comparative Example C was prepared identically to that of Comparative Example B with the exception that the abrasive grains applied were 362.5 g/m$^2$ of grade 50 "CUBITRON" mineral and 242 g/m$^2$ of grade 50 brown aluminum oxide (both available from Minnesota Mining and Manufacturing Company, St. Paul, Minn.).

COMPARATIVE EXAMPLE D

Comparative example D was prepared identically to that of Comparative Example B with the exception that the abrasive grains applied were 513.6 g/m$^2$ of grade 50 brown aluminum oxide and 90.6 g/m$^2$ of grade 50 "CUBITRON" mineral.

Comparative Examples B through D were tested according to the steel ring grinding test with the test results set forth in Tables 3 and 4.

TABLE 3

| | Cut rate (grams/8 minutes) | | |
|---|---|---|---|
| TIME (MIN) | C. Ex B | C. Ex C | C. Ex D |
| 8 | 183 | 289.9 | 191.8 |
| 16 | 260.7 | 247.6 | 139.1 |
| 24 | 249.5 | 231.7 | 118 |
| 32 | 238 | 215.2 | 119.3 |
| 40 | 209.5 | 200.6 | 111.2 |
| 48 | 205.2 | 192.9 | |
| 56 | 200.6 | 186.6 | |
| 64 | 192.9 | 170.2 | |
| 72 | 183.9 | 159 | |
| 80 | 162.4 | | |
| 88 | 134.8 | | |

TABLE 4

| | Cumulative cut (g) | | |
|---|---|---|---|
| TIME (MIN) | C. Ex. B | C. Ex. C | C. Ex. D |
| 8 | 183 | 289.9 | 191.8 |
| 16 | 443.7 | 537.5 | 330.9 |
| 24 | 693.2 | 769.2 | 448.9 |
| 32 | 931.2 | 984.4 | 568.2 |
| 40 | 1140.7 | 1185 | 679.4 |

TABLE 4-continued

| | Cumulative cut (g) | | |
|---|---|---|---|
| TIME (MIN) | C. Ex. B | C. Ex. C | C. Ex. D |
| 48 | 1345.9 | 1377.9 | |
| 56 | 1546.5 | 1564.5 | |
| 64 | 1739.4 | 1734.7 | |
| 72 | 1923.3 | 1893.7 | |
| 80 | 2085.7 | | |
| 88 | 2220.5 | | |

Example 7

Example 7 demonstrates the manufacture of an abrasive wheel. A air laid lofty, open nonwoven web of about 200 g/m$^2$ of 70 denier×2 inch (78 decitex×51 mm) nylon 6,6 staple fiber was formed on a "Rando Weber" (Rando Machine Company, Macedon, N.Y.) machine. A prebond coating (consisting of a mixture of 63.40% PR, 35.50% water, and 1.10% of a 50% NaOH solution in water) was applied and cured at 154° C. for 6 minutes in a forced air convection oven to produce a prebonded web of 264 g/m$^2$. The resulting composite was roll coated onto one of the major surfaces of the web with a make coat precursor of the composition shown in Table 5 to achieve a dry add-on weight for the make coat of 1022 g/m$^2$. Abrasive particles (grade 40 "CUBITRON" material) was drop-coated onto one surface of the web to achieve an add on weight of 635 g/m$^2$. The make coat precursor was dried for 2 minutes at 135° C. to reduce volatiles to about 11% by weight. The size coat precursor of the composition shown in Table 5 was then roll coated onto one of the major surfaces of the web to achieve a dry add-on of 813 g/m$^2$. The composite was then heated an additional 2 minutes at about 149° C. to reduce residual volatiles to 37% by weight. From this composite, annuli were cut of 27.9 cm o.d. and 14.0 cm i.d. Concentric stacks of 5 or 6 of these dried but uncured annuli were mounted onto a shaft, compressed to 2.45 cm thickness, and cured in the compressed state in an oven for 3 hours at 91° C. The oven temperature was then raised to 121° C. and the compressed composite was further allowed to cure for 5 hours. The composite was then allowed to cool to room temperature and was removed from the shaft. A 5" (12.7 cm) i.d. polyurethane core was then cast into the i.d. of the annulus and allowed to cure at room temperature for less than one hour. The resulting abrasive article was then mounted on a lathe and the o.d. was dressed to assure that the o.d. was concentric to the i.d.

The resulting abrasive wheel was tested by urging stainless steel, brass, and aluminum coupons, into it's rotating surface (1800 rpm) for 3 seconds. Substantial material removal was noted for each test coupon, and the residual finish appeared to be that typical of a (vitrified) grinding wheel.

TABLE 5

| Component | Make Coat Precursor | Size Coat Precursor |
|---|---|---|
| Phenolic Resin (PR) | 39.55 | 50.01 |
| calcium carbonate | 32.58 | 41.18 |
| abrasive particles (grade 40 "Cubitron") | 22.21 | 0 |
| propylene glycol monomethyl ether | 1.09 | 1.77 |
| filmed silica | 0.22 | 0 |
| water | 4.35 | 7.04 |

COMPARATIVE EXAMPLE E

To a 880 g/m$^2$ scrim-reinforced nonwoven web (prepared as described above), a slurry was prepared consisting of 33.9% PR, 27.9% calcium carbonate, 1.1% POLYSOLV solvent, 4.0% water, 33.1% grade 50 CUBITRON 222 abrasive particles, and sufficient CAB-O-SIL fumed silica to achieve a viscosity of about 11,000 centipoise. The slurry was sprayed onto one side of the reinforced web to achieve a dry add-on of 3515 g/m$^2$. The spray coater was set at 75 psi tank pressure, 80 psi atomizing pressure, employed an external-atomizing nozzle (Binks #69 obtained from Binks Manufacturing Company, Franklin Park, Ill.) and was operated at a distance of about 14 inches (about 35.6 cm) from the scrim-reinforced web. In order to achieve the required high add-on, two passes at 5 feet/minute (1.52 m/minute) were required. Following the second pass through the spray coater, the freshly-coated material was passed through a two-zone oven with the zones set at 70° C. (first 5.5 meters) and 110° C. (next 11 meters), respectively. The dried composite was then cut into sheets of dimensions 42 inches by 20 inches (106.7 cm by 50.8 cm) and placed on racks in a walk-in oven. The sheets were further cured for 3 hours at 91° C. followed by further treatment for 5 hours at 121° C. From these cured sheets were cut disc specimens 7 inches (17.8 cm) in diameter with a ⅞ inch arbor hole (2.2 cm) and weighing about 110 grams each for use testing. (PPX 9020)

The foregoing article of Comparative Example E was tested according to the above described Steel Ring Grinding Test along with articles made according to Comparative Example A and inventive Example 6 in order to demonstrate the importance of the inventive method of making the articles of the present invention. The results are shown in Table 6.

TABLE 6

| | Cut (g/8 min.) | | |
|---|---|---|---|
| TIME | C. Ex. E | C. Ex A | Example 6 |
| 8 | 130 | 118 | 227 |
| 16 | 159 | 101 | 299 |
| 24 | 161 | 88 | 229 |
| 32 | 161 | 82 | 230 |
| 40 | 159 | 72 | 215 |
| 48 | 135 | 63 | 208 |
| 56 | 129 | 51 | 202 |
| 64 | 135 | 47 | 202 |
| 72 | 144 | 48 | 194 |
| 80 | 129 | 56 | 195 |
| 88 | 128 | 65 | 206 |
| 96 | 135 | 63 | 202 |
| 104 | 134 | 63 | 200 |
| 112 | 118 | 60 | 197 |
| 120 | 134 | 57 | 200 |
| 128 | 131 | 61 | 195 |
| 136 | 136 | 53 | 198 |
| 144 | 145 | 51 | 194 |
| 152 | 140 | 48 | 200 |
| 160 | 109 | | 195 |
| 168 | 74 | | 197 |
| 176 | | | 191 |
| 184 | | | 192 |
| 192 | | | 198 |
| 200 | | | 202 |
| 208 | | | 206 |
| 216 | | | 204 |
| 224 | | | 189 |
| 232 | | | 177 |
| 240 | | | 162 |
| 248 | | | 145 |
| 256 | | | 129 |

The above results unexpectedly indicate the importance of the preparative method in extending the useful life of the surface treating articles according to the invention. Although Comparative Example E was prepared with comparable coating weights, the spray application of the resins did not provide for sufficient penetration of the resins into the structure of the nonwoven web. In Comparative Example E, the cured resin coatings were positioned at the uppermost surface of the web. The resins used in Example 6 penetrated through the web, extending from the surface of the woven backing up through the web with fibers from the web being visible above the uppermost surface of the web. Consequently, the article of Comparative Example E failed much earlier than the article of Example 6. Even within the added coating weights for the resins used in Comparative Example E, the overall useful life of the article was not significantly longer than the standard prior art article of Comparative Example A. The higher cut rate for Comparative Example E over that of Comparative Example A is attributed to the nature of the abrasive particles used to make the different articles.

Although the preferred embodiment has been described in detail, it will be appreciated that changes and modifications to the described embodiments can be made by those skilled in the art without departing from the spirit and scope of the invention.

We claim:

1. An abrasive article, comprising:

a backing having a first major surface and a second major surface;

a first resin layer comprising a first hardened resin having a dry coating weight of about 400 g/m$^2$ or greater, the first resin layer extending over the first major surface of the backing, wherein the first hardened resin is selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, epoxy resins having fluorine substituent groups, and combinations thereof;

abrasive particles adhered within the first resin layer;

a second resin layer applied over the first resin layer having a dry coating weight of about 400 g/m$^2$ or greater, the second resin layer comprising a second hardened resin, wherein the second resin comprises a flexible material selected from the group consisting of polyurethanes, polyureas, styrene-butadiene rubbers, nitrile rubbers, polyisoprene, and combinations of the foregoing materials; and a lofty, three dimensional, nonwoven web of fibers bonded to one another at their mutual contact points and extending through the first and second hardened resin layers, wherein the first and second resin layers substantially penetrate and fill the nonwoven web of fibers that extend through the resin layers.

2. The abrasive article as defined in claim 1 wherein the backing is a reinforcing fabric, and wherein fibers from the nonwoven web extend through the fabric.

3. The abrasive article as defined in claim 1 wherein the abrasive particles are selected from the group consisting of aluminum oxide, silicon carbide, alumina zirconia, diamond, ceria, cubic boron nitride, garnet, and combinations thereof.

4. The abrasive article as defined in claim 3 wherein the aluminum oxide is selected from the group consisting of ceramic aluminum oxide, heat-treated aluminum oxide, white-fused aluminum oxide and combinations thereof.

5. The abrasive article as defined in claim 1 wherein the polyester is polyethylene terephthalate.

6. The abrasive article as defined in claim 1 wherein the nylon is selected from hexamethylene adipamide, polycaprolactum and combinations thereof.

7. The abrasive article as defined in claim 1 wherein the fibers of the nonwoven web are bonded to one another at their mutual contact points by a material selected from the group consisting of polyurethanes, polyureas, styrene-butadiene rubbers, nitrile rubbers, polyisoprene and combinations of the foregoing materials.

8. An abrasive article, comprising:

a nonwoven web of fibers bonded to one another, the fibers defining a first major web surface, a second major web surface and a middle web portion extending between the first and second major web surfaces;

a first resin layer extending through the web and comprising a first hardened resin, the dry weight of the first resin layer being at least about 400 g/m$^2$, wherein the first hardened resin is selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, epoxy resins having fluorine substituent groups, and combinations thereof;

abrasive particles adhered within the first resin layer;

a second resin layer applied over the first resin layer and comprising a second hardened resin, the dry weight of the second resin layer being at least about 400 g/m$^2$, wherein the second resin comprises a flexible material selected from the group consisting of polyurethanes, polyureas, styrene-butadiene rubbers, nitrile rubbers, polyisoprene, and combinations of the foregoing materials, wherein the first and second resin layers substantially penetrate and fill the nonwoven web of fibers that extend through the resin layers.

9. The article as defined in claim 8 wherein the fibers comprise materials selected from the group consisting of polyester, nylon, polypropylene, acrylic polymer, rayon, cellulose acetate polymer, polyvinylidene chloride-vinyl chloride copolymers, vinyl chloride-acrylonitrile copolymers, cotton, wool, jute, hemp and combinations of the foregoing materials.

10. The article as defined in claim 8 wherein the fibers of the nonwoven web are bonded to one another at their mutual contact points by a hardened prebond resin comprising material selected from the group consisting of polyurethanes, polyureas, styrene-butadiene rubbers, nitrile rubbers, polyisoprene and combinations of the foregoing materials.

11. The article as defined in claim 10 wherein the dry coating weight of the hardened prebond resin is about 200 g/m$^2$ or greater.

12. The abrasive article as defined in claim 8 wherein the abrasive particles are selected from the group consisting of aluminum oxide, silicon carbide, alumina zirconia, diamond, ceria, cubic boron nitride, garnet, and combinations thereof.

13. The abrasive article as defined in claim 12 wherein the aluminum oxide is selected from the group consisting of ceramic aluminum oxide, heat-treated aluminum oxide, white-fused aluminum oxide and combinations thereof.

14. The abrasive article as defined in claim 8 further comprising a reinforcing fabric affixed to the first major surface of the nonwoven web, fibers from the nonwoven web extending through the reinforcing fabric.

15. A layered composite comprising a plurality of compressed abrasive articles as defined in claim 8.

16. The layered composite as defined in claim 15, wherein the composite is a wheel suitable for grinding applications.

17. A method for the manufacture of an abrasive article, comprising:

providing an open, lofty, three dimensional nonwoven web of fibers having a first major web surface and a second major web surface and a middle web portion extending therebetween, the fibers bonded to one another at their mutual contact points;

applying a first coatable composition to the nonwoven web in an amount sufficient to provide a dry coating weight of about 400 g/m$^2$ or greater, wherein the first coatable composition is selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, epoxy resins having fluorine substituent groups, and combinations thereof;

applying abrasive particles to the first coatable composition;

at least partially hardening the first coatable composition;

applying a second coatable composition to the nonwoven web in an amount sufficient to provide a dry add-on weight of about 400 g/m$^2$ or greater, wherein the second coatable composition comprises a flexible material selected from the group consisting of polyurethanes, polyureas, styrenbutadiene rubbers, nitrile rubbers, polyisoprene, and combinations of the foregoing materials; and hardening the second coatable composition, wherein the first and second hardened compositions substantially penetrate and fill the nonwoven web of fibers that extend through the coatable composition layers.

18. The method as defined in claim 17 wherein providing an open, lofty, three dimensional nonwoven web comprises:

forming an unbonded nonwoven web of fibers;

applying a coatable prebond resin to the unbonded nonwoven web of fibers to provide a dry add-on weight of about 200 g/m$^2$ or greater; and hardening the prebond resin to bond the fibers to one another at their mutual contact points.

19. The method as defined in claim 18 wherein the prebond resin is selected from the group consisting of polyurethanes, polyureas, styrene-butadiene rubbers, nitrile rubbers, polyisoprene and combinations of the foregoing materials.

20. The method as defined in claim 17 wherein the abrasive particles are selected from the group consisting of aluminum oxide, silicon carbide, alumina zirconia, diamond, ceria, cubic boron nitride, garnet, and combinations thereof.

21. The method as defined in claim 20 wherein the aluminum oxide is selected from the group consisting of ceramic aluminum oxide, heat-treated aluminum oxide, white-fused aluminum oxide and combinations thereof.

22. The method as defined in claim 17 further comprising:

applying a third coatable composition to the nonwoven web to provide a dry add-on weight of about 200 g/m$^2$ or greater, wherein the third coatable composition comprises a flexible material selected from the group consisting of polyurethanes, polyureas, styrene-butadiene rubbers, nitrile rubbers, polyisoprene, and combinations of the foregoing materials; or is selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, epoxy resins having fluorine substituent groups, and combinations thereof;

hardening the third coatable composition, wherein the first, second, and third hardened compositions substantially penetrate and fill the nonwoven web of fibers that extend through the coatable composition layers.

23. The method as defined in claim 17 wherein, prior to applying a first coatable composition, the method further comprises:

applying a reinforcing fabric to the second major surface of the nonwoven web; and affixing the reinforcing fabric to the nonwoven web.

24. The method as defined in claim 23 wherein the affixing is accomplished by needletacking.

* * * * *

UNITED STATES PATENT AND TRADEMARK OFFICE

CERTIFICATE OF CORRECTION

PATENT NO. : 5,919,549
DATED : July 6, 1999
INVENTOR(S) : Loc X. Van, Eugene J. Miller, Leonard E. Nelson It is certified that error appears in the above-identified patent and that said Letters Patent is hereby corrected as shown below:

Column 1,
Line 3, after Title, before "Background of the Invention", insert -- The present invention relates to abrasive articles and to a method for the manufacture of the articles. --

Column 8,
Line 24, "Co." should read -- Co.). --.

Column 13,
Lines 31, 32, "density" should read -- densify --.

Column 20,
Table 1, Time: 104, Example 6, "260" should read -- 200 --.

Column 21,
Table 1, Time: 144, Example 4, "442" should read -- 142 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*